US005168270A

United States Patent [19]

Masumori et al.

[11] Patent Number: 5,168,270

[45] Date of Patent: Dec. 1, 1992

[54] LIQUID CRYSTAL DISPLAY DEVICE CAPABLE OF SELECTING DISPLAY DEFINITION MODES, AND DRIVING METHOD THEREFOR

[75] Inventors: Tadaaki Masumori, Kodaira; Tadamichi Kawada, Urawa; Yukio Takahashi, Toyko; Tadao Nakamura, Sakai; Masaru Yasui; Takeo Kamiya, both of Kobe, all of Japan.

[73] Assignees: Nippon Telegraph and Telephone Corporation, Tokyo; Hosiden Corporation, Osaka, both of Japan

[21] Appl. No.: 698,988

[22] Filed: May 13, 1991

[30] Foreign Application Priority Data

May 16, 1990 [JP] Japan ..... 2-124078
May 16, 1990 [JP] Japan ..... 2-124079

[51] Int. Cl.[5] ..... G09G 3/36

[52] U.S. Cl. ..... 340/784; 358/230; 358/56

[58] Field of Search ..... 340/784 A, 784 B, 784 C, 340/784 E, 784 J, 784; 358/230, 140, 11, 236, 56

[56] References Cited

U.S. PATENT DOCUMENTS 4,568,964 2/1986 Doornhein ..... 358/11
4,745,485 5/1988 Iwasaki ..... 358/236

FOREIGN PATENT DOCUMENTS 0264918 4/1988 European Pat. Off. .

OTHER PUBLICATIONS

Patent Abstracts of Japan, vol. 9, No. 277 (E355) (2000) Nov. 6, 1985 & JPA-60 120678, Jun. 25, 1955.
Patent Abstracts of Japan, vol. 7, No. 226 (E-202) Oct. 7, 1983 & JP-A-58 115991, Jul. 9, 1983.
Patent Abstracts of Japan, vol. 9, No. 75 (E-306) Apr. 4, 1985 & JP-A-59 208986, Nov. 27, 1984.

*Primary Examiner*—Jeffery A. Brier
*Assistant Examiner*—A. Au
*Attorney, Agent, or Firm*—Pollock, Vande Sande and Priddy

[57] ABSTRACT

An input analog image signal is sampled by first and second A/D converters, using first and second sampling clocks of the same period, to obtain digital gradation data. In the case of a double definition display mode, the first and second sampling clocks are made 180° out of phase with each other and the output of the first A/D converter is delayed for one-half period, by which its timing is brought into agreement with that of the output of the second A/D converter, thus obtaining a pair of digital gradation data. In the case of a standard definition display mode, the first and second sampling clocks of the same phase are used to obtain the outputs of the first and second A/D converters as a pair of digital gradation data. The pair of digital gradation data Da and Db is converted by a signal processing part into a pair of analog gradation data Aa and Ab, which is subjected to a serial-to-parallel conversion by a source driver to be supplied in parallel to data lines. In the double definition display mode the gate driver sequentially drives odd-numbered row lines in odd-numbered frames and even-numbered row lines in even-numbered frames. In the standard definition display mode every two adjacent row lines are simultaneously driven in a sequential order.

15 Claims, 9 Drawing Sheets

FIG. 1A PRIOR ART

| i \ j | 1 | 2 | 3 | 4 | ····· | 2m-1 | 2m | PIX COLUMN |
|---|---|---|---|---|---|---|---|---|
| | 1 | 2 | 3 | 4 | ····· | 2m-1 | 2m | |
| 1 | A1 | A2 | A3 | A4 | ····· | A2m-1 | A2m | |
| 2 | A2m+1 | | | | ····· | A4m-1 | A4m | |
| ⋮ | ····· | ····· | ····· | ····· | ····· | ····· | ····· | |
| 2n | A(2n-1)x2m+1 | | | | ····· | A2nx2m-1 | A2nx2m | |
| PIX ROW | | | | | | | | |

FIG. 1B PRIOR ART

| i \ j | 1 | 2 | 3 | 4 | 5 | 6 | C | C | ····· | 2m-1 | 2m | C-PIX COLUMN |
|---|---|---|---|---|---|---|---|---|---|---|---|---|
| | 1 | 2 | | | 3 | 4 | | | | | | |
| | 1 | 2 | 3 | 4 | 5 | 6 | | | 3m-2 | 3m-1 | 3m | |
| 1 | 1 | R1 G1 | B2 | R3 G3 | | B4 | | | ····· | R3m-1 G3m-1 | B3m | |
| | 2 | B1 | R2 G2 | B3 | R4 G4 | | | | ····· | B3m-1 R3m | G3m | |
| 2 | 3 | R3m+1 | | | | | | | ····· | R6m-1 | G6m-1 | B6m |
| ⋮ | 4 | B3m+1 | | | | | | | ····· | B6m-1 | R6m | G6m |
| ⋮ | ⋮ | ····· | ····· | ····· | ····· | ····· | ····· | ····· | ····· | ····· | ····· | ····· |
| 2n | 4n-1 | R(2n-1)x3m+1 | | | | | | | ····· | R2nx3m-1 | G2nx3m-1 | B2nx3m |
| | 4n | B(2n-1)x3m+1 | | | | | | | ····· | B2nx3m-1 | R2nx3m | G2nx3m |
| C-PIX ROW | | | | | | | | | | | | |

FIG. 1C PRIOR ART

| i \ j | 1 | 2 | 3 | 4 | 5 | 6 | C | C | ····· | 2m | C-PIX COLUMN |
|---|---|---|---|---|---|---|---|---|---|---|---|
| | 1 | | | | 2 | | | | | | |
| | 1 | 2 | 3 | 4 | 5 | 6 | | | 6m-2 | 6m-1 | 6m |
| 1 | 1 | R1 G1 B1 | | | R2 G2 B2 | | | | ····· | R2m G2m B2m | |
| 2 | 2 | R2m+1 | | | | | | | ····· | R4m G4m B4m | |
| ⋮ | ⋮ | ····· | ····· | ····· | ····· | ····· | ····· | ····· | ····· | ····· | ····· |
| 2n | 2n | R(2n-1)x2m+1 | | | | | | | ····· | R2nx2m G2nx2m B2nx2m | |
| C-PIX ROW | | | | | | | | | | | |

LIQUID CRYSTAL DISPLAY DEVICE CAPABLE OF SELECTING DISPLAY DEFINITION MODES, AND DRIVING METHOD THEREFOR

BACKGROUND OF THE INVENTION

The present invention relates to a multi-gradation liquid crystal display device which is capable of freely switching between a standard definition image display and a double definition image display. The invention also pertains to a method for driving such a multi-gradation liquid crystal display device.

Conventionally, a multi-gradation liquid crystal display device includes drivers for driving column lines (also referred to as source or data lines) and row lines (also referred to as gate lines) arranged in a two-dimensional matrix form in a display panel. An electric signal corresponding to image data of one row line is set in the source driver for driving the column lines. The row lines are selectively driven by the gate driver, while at the same time the above-mentioned electric signal is provided via the column lines from the source driver to all picture elements (each of which is a smallest display unit defined by one of display electrodes arranged in a matrix form on the display panel) connected to a selected one of the row lines; thus, gradation data is written. This operation is repeated for each of the row lines which are selected in a sequential order.

Generally, analog image data is transferred to the source driver of the multi-gradation liquid crystal display device and stored in its memory after voltage level conversion and rearrangement for picture elements. All pieces of the image data for all picture elements to be connected to a selected one of row lines, thus set in the memory of the source driver, are simultaneously provided therefrom onto the column lines, and in synchronism with this, the row line concerned is selectively driven by the gate driver. During this period all pieces of image data for all picture elements to be connected to the next row line are transferred to and stored in another memory of the source driver from the outside. Upon completion of the outputting the image data to the column lines and upon completion of the selective driving of the row line concerned, the next line is selected and all the corresponding pieces of image data stored in the memory are provided onto the column lines. These operations are repeated for each of the uppermost to the lowermost row lines of the two-dimensional matrix in the display panel to provide thereon a display.

Alternatively, analog image data or the like from a computer or similar source, for example, is once converted to digital image data, which is subjected to various image processing and then converted to analog form for sequential input into a memory in the source driver. Thereafter, the analog image data is provided to all picture elements connected to one row line by the operation of the source driver and the gate driver in the same manner as mentioned above, and a display is produced by the repetition of such operations.

In the two-dimensional matrix form of arrangement of the row and column lines in the multi-gradation liquid crystal display panel, picture elements are arranged in various forms. In the case of a monochrome display, picture elements $A_{2m(i-1)+1}$ to $A_{2mi}$ corresponding to each row line i (i=1, 2, . . . , 2 n) are all connected thereto as shown in FIG. 1A. In the case where red (R), green (G) and blue (B) picture elements constituting each color pixel C for a color display are arranged, for instance, in a delta form, the R, G and B picture elements are selectively connected to two gate lines as shown in FIG. 1B. In the case where the R, G and B picture elements forming each color pixel C are arranged in a stripe form, they are connected to one row line as shown in FIG. 1C. In these cases, the driving method by the gate driver differs according to the manner of data storage in the source driver and its output to the column lines. The prior art therefore requires, for a double definition display and for a standard definition display, different display panels having different numbers of column and row lines and different source and gate drivers.

Incidentally, technology of this kind is introduced in "Handbook on Liquid Crystal Devices" Nikkan Kogyo Shimbunsha, 1980, in which a drive and write system for liquid crystal displays is described at pages 387 to 466 and a color display system for liquid crystal displays at 467 to 523.

As mentioned above, the prior art needs different liquid crystal display panels dedicated to a double definition display and a standard definition display, respectively. Further, since input image signals handled in such display panels differ in signal rate, the source and gate drivers differ in operating speed with panels accordingly, and the prior art has dealt with this problem by changing their constructions or by employing different drivers. Since these drivers drive large numbers of column and row lines in the panel, dedicated multi-output ICs with many drive terminals have been developed, and as the source driver, various ICs have also been developed which perform digital image signal processing or analog image signal processing, depending on whether the display to be provided is a monochrome, multicolor or full-color display. However, such ICs are used equivocally in accordance with the definition of the liquid crystal display panel and the color to be displayed, and the same display panel and the same circuit construction are not used in common to the double definition display and the standard definition display, for example, but instead different kinds of display panels and drivers are prepared and selectively used for each particular display.

SUMMARY OF THE INVENTION

It is therefore an object of the present invention to provide a liquid crystal display device which is capable of producing both of the double definition display and the standard definition display on a double definition liquid crystal display panel by use of the same drivers, and a method for driving such a liquid crystal display device.

To attain the above objective, the present invention employs a double definition display panel and, in the source driving system, two A/D converters for input analog image signal, and depending on whether the input analog image signal from the outside is a double definition or standard definition image signal, the phases of sampling clocks which are applied to the two A/D converters are changed for each particular data processing in the source driving system; so that the same source driver can be used in common to both of the double definition display and the standard definition display. The gate driver selects, in the case of the double definition display, one row line (a gate line) in synchronization with the outputs from the source driver and, in the case of the standard definition display, simultaneously selects two adjacent row lines or two row lines adjacent but spaced one line apart.

With the above-described liquid crystal display device and driving method therefor, the double definition display and the standard definition display can selectively be provided, with ease, by use of the same liquid crystal display panel and the same source and gate drivers, in accordance with the input image signal.

BRIEF DESCRIPTION OF THE DRAWINGS

FIG. 1A is a diagram showing the picture element arrangement of a monochrome liquid crystal display panel;

FIG. 1B is a diagram showing delta arrangements of R, G and B picture elements of a color liquid crystal display panel;

FIG. 1C is a diagram showing stripe arrangements of R, G and B picture elements of another color liquid crystal display panel;

DESCRIPTION OF THE PREFERRED EMBODIMENTS

First Embodiment

Figure 2:
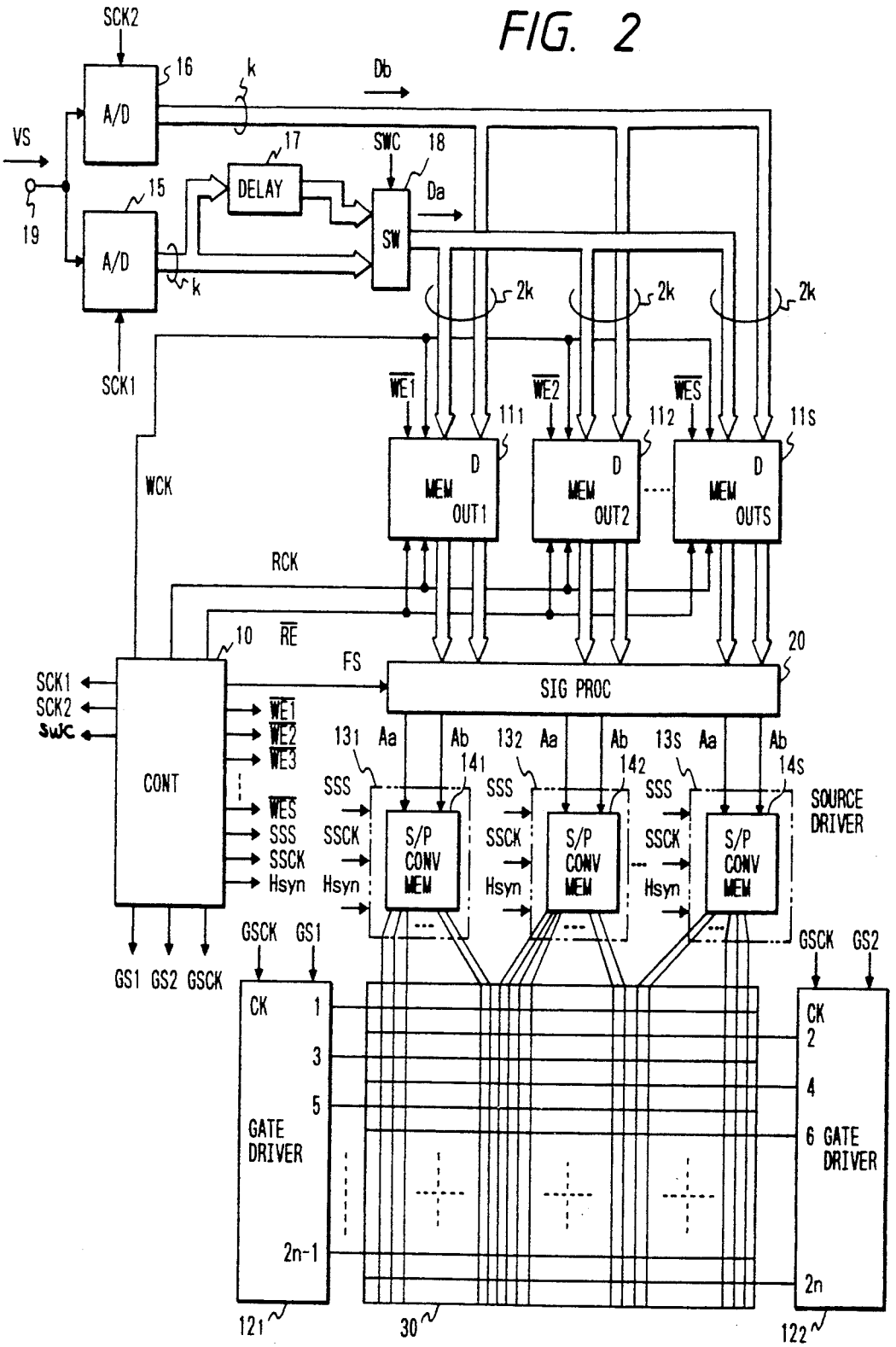
FIG. 2 is a block diagram illustrating an embodiment of the present invention.

FIG. 2 illustrates in block form an embodiment of the circuit arrangement employing the liquid crystal display drive system of the present invention. This embodiment is shown to be supplied with an analog image signal VS at an input terminal 19 from the outside.

Figure 3:
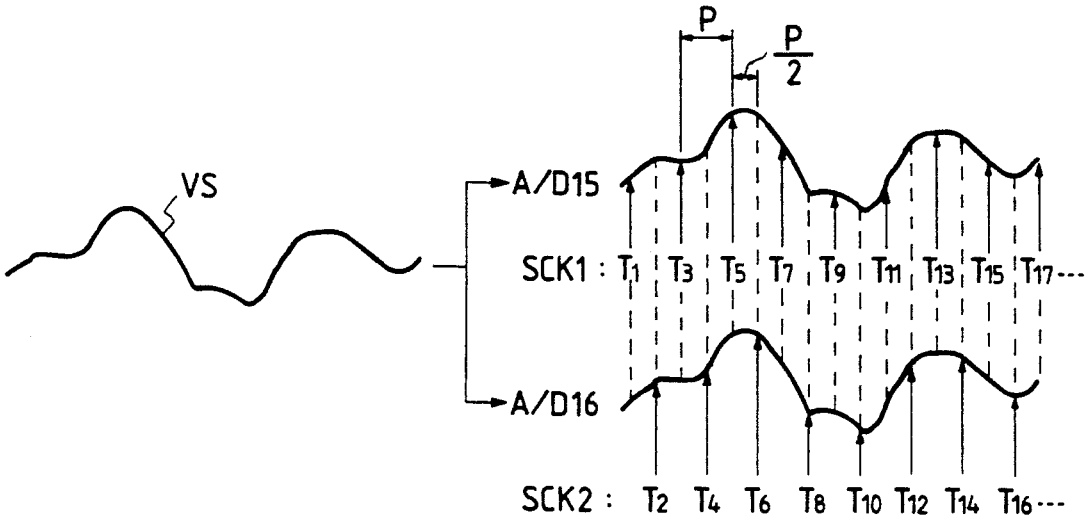
FIG. 3 is a diagram for explaining the sampling of a waveform in the case of the double definition display.
Figure 4:
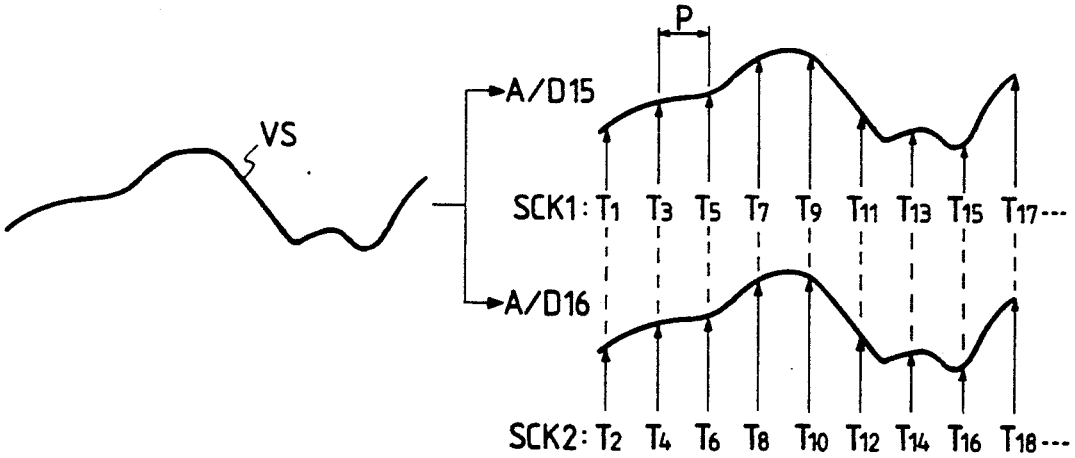
FIG. 4 is a diagram for explaining the waveform sampling in the case of the standard definition display.

A multi-gradation liquid crystal display panel 30 is shown to be composed of 2 m (m being an integer) column lines and 2 n (n being an integer) row lines as in the case of FIG. 1A. In this embodiment the input analog image signal VS is applied to two A/D converters 15 and 16, wherein it is converted to k-bit digital gradation sample data in synchronization with sampling clocks SCK1 and SCK2 of the same period P which are applied from a control part 10. The control part 10 generates the sampling clocks SCK1 and SCK2 in phase with each other in the case of providing a standard definition display, but in the case of providing a double definition display, it delays one of the sampling clocks by a phase difference of 180°, generating sampling clocks SCK1 and SCK2 180° out of phase with each other. The output of the A/D converter 15 is applied to the one input of a select switch 18 and a delay circuit 17. The delay circuit 17 delays the output digital signal of the A/D converter 15 by one-half of the period P of the sampling clock SCK1 and the delayed output is provided to the other input of the select switch 18. In the case of the double definition display, the control part 10 applies a high-level switch control signal SWC to the select switch 18 to select the output of the delay circuit 17, whereas in the case of the standard definition display it applies a low-level switch control signal SWC to the select switch 18 to select the output of the A/D converter 15. Consequently, in the case of the double definition display, the A/D converters 15 and 16 sample the input analog image signal VS alternately with each other at different time points $T_1$, $T_3$, $T_5$, . . . and $T_2$, $T_4$, $T_6$, . . . (hence, the output sample values differ from each other accordingly) as shown in FIG. 3. In the case of the standard definition display, the A/D converters 15 and 16 sample the input analog image signal VS at the same sequence of timings (hence, the two sequences of output sample values are equal to each other) as depicted in FIG. 4. In either case, the timing of sample data Da output from the select switch 18 and the timing of sample data Db output from the A/D converter 16 are in agreement with each other and their periods are the same as those P of the sampling clocks SCK1 and SCK2.

The gradation sample data Da selected by the select switch 18 and the output gradation sample data Db of the A/D converter 16 are provided, as a pair of gradation data (picture element data) for two adjacent picture elements, to S memories $\mathbf{11}_1$ to $\mathbf{11}_S$ every sampling clock period P. A sequence of such m consecutive pairs of data, that is, 2 m pieces of data, are used as data for 2 m picture elements which are connected to one row line of the liquid crystal display. Such a sequence of paired pieces of digital gradation data Da and Db are stored, in units of m/S pairs, in each of the first to Sth memories $\mathbf{11}_1$ to $\mathbf{11}_S$, after which the m/S pairs of data in each of the memories $\mathbf{11}_1$ to $\mathbf{11}_S$ are read out therefrom in a sequential order. The S memories $\mathbf{11}_1$ through $\mathbf{11}_S$ are read out in parallel. That is, the S memories $\mathbf{11}_1$ through $\mathbf{11}_S$ convert the sequence of paired pieces of data Da and Db into data pairs of S series, thereby affording a sufficient margin for data processing described below.

In this embodiment the memories $\mathbf{11}_1$ through $\mathbf{11}_S$ are each formed by a commercially available FIFO memory, which includes a write address counter which is incremented upon each application of a write clock WCK and a read address counter which is incremented upon each application of a read clock RCK; so that each FIFO memory permits simultaneous write and read of data, but the data which is read out is data of the immediately preceding line already written in the memory. The memories $\mathbf{11}_1$ through $\mathbf{11}_S$ are each supplied with a pair of k-bit data Da and k-bit data Db, for example, in the form of data D of a 2 k-bit word composed of k high order bits and k low order bits. The memories $11_1$ through $11_S$ are supplied, in common to them, with the write clock WCK, the read clock RCK and a read enable $\overline{RE}$ from the control part 10.

Now, let the pieces of data D of one row line (the number of picture elements being 2 m) of the display be represented by $D_1, D_2, \ldots, D_m$. As shown in the timing chart of FIG. 5, while the memory $11_1$ is supplied with a write enable $\overline{WE1}$ of a period mP/S, first to m/S-th pieces of data $D_1$ to $D_{m/S}$ are sequentially written into m/S addresses of the memory $11_1$ in synchronization with the write clock WCK. Next, m/S+1-th data $D_{m/S+1}$ to 2m/S-th data $D_{2m/S}$ are written into m/S addresses of the memory $11_2$ being supplied with the write enable $\overline{WE2}$. Thereafter, write enables $\overline{WE3}$, $\overline{WE4}, \ldots, \overline{WES}$ are sequentially applied to the memories $11_3, 11_4, \ldots, 11_S$ and pieces of data $D_{2m/S+1}$, $D_{2m/S+2}, \ldots, D_m$ are sequentially written into their m/S addresses in units of m/S pieces.

Figure 5:
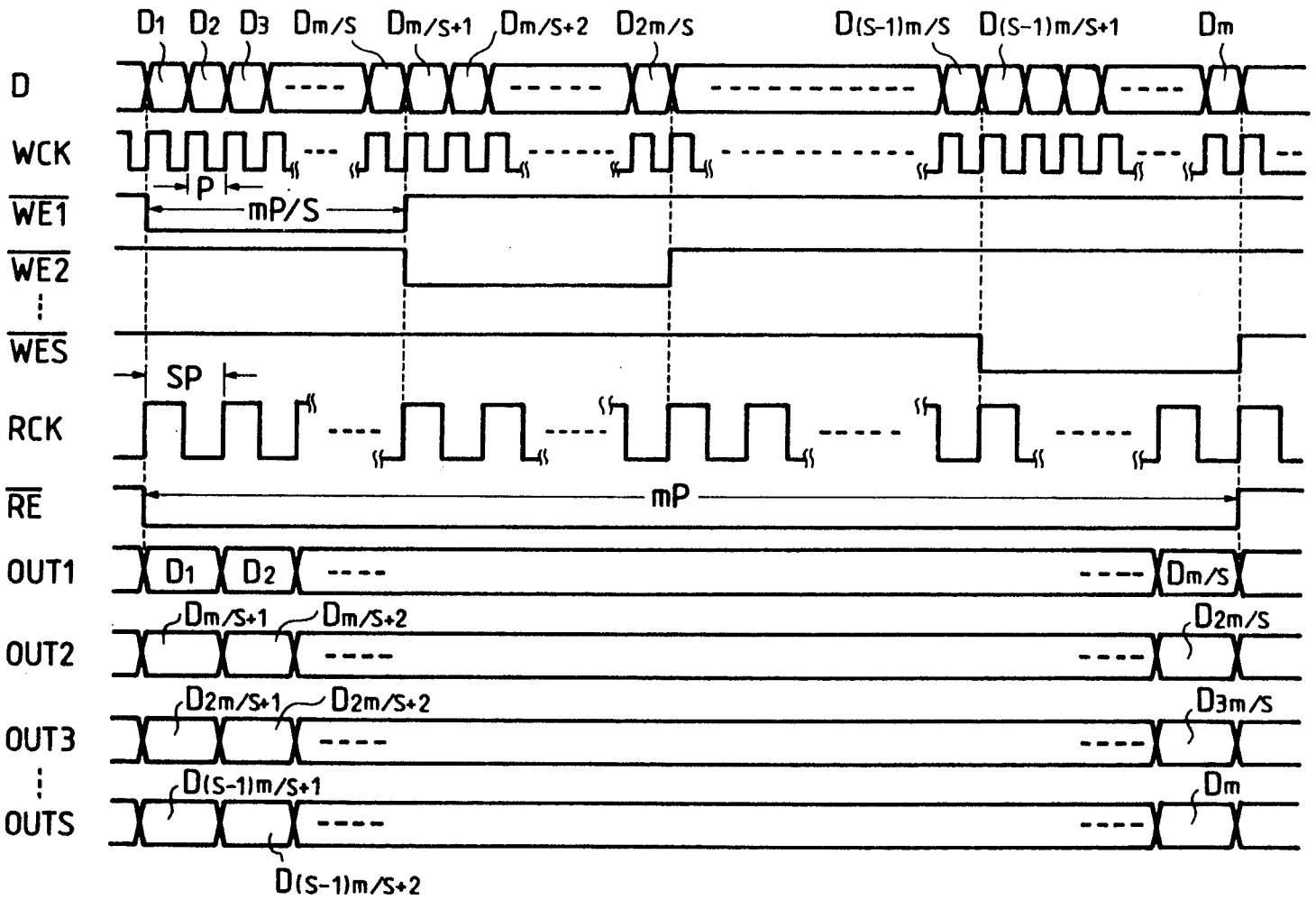
FIG. 5 is a timing chart for explaining the operation of the embodiment shown in FIG. 2.

The read enable $\overline{RE}$, which lasts through the period mP from the start of writing the data of one line to the completion thereof as shown in FIG. 5, is applied to the memories $11_1, 11_2, \ldots, 11_S$ in common to them. These memories are read out in parallel in synchronization with the read clock RCK of a period SP. As a result of this, m/S pieces of data (2m/S pieces of picture element data), $\{D_1, D_2, \ldots, D_{m/S})\}$, $\{D_{m/S+1}, D_{m/S+2}, \ldots, D_{2m/S}\}, \ldots, \{D_{(S-1)m/S+1}, D_{(S-1)m/S+2}, \ldots, D_m\}$, are provided at outputs OUT1, OUT2, . . . , OUTS of the memories $11_1, 11_2, \ldots, 11_S$, respectively. That is to say, in the period mP gradation data for a row line where a display is to be produced is written into the memories $11_1, 11_2, \ldots, 11_s$, and at the same time, data of all picture elements on the preceding line is read out therefrom. The pieces of gradation data D each of 2 k-bit word thus read out of the memories $11_1, 11_2, \ldots, 11_S$ are supplied in parallel to a signal processing part 20 as S pairs of k-bit word gradation data Da and Db.

In the signal processing part 20 the S pairs of gradation data Da and Db thus provided thereto are sequentially converted to pairs of analog gradation data Aa and Ab, which are supplied in parallel to memories $14_1$ through $14_S$ in source driver divisions $13_1$ through $13_S$ of the same number S as that of the memories $11_1$ through $11_S$. The source driver divisions $13_1$ through $13_S$, which constitute a source driver, convert a series of m/S pairs of analog gradation data Aa and Ab input thereto to pieces of parallel data, which are provided in parallel on the corresponding data buses of the display panel 30.

Figure 6:
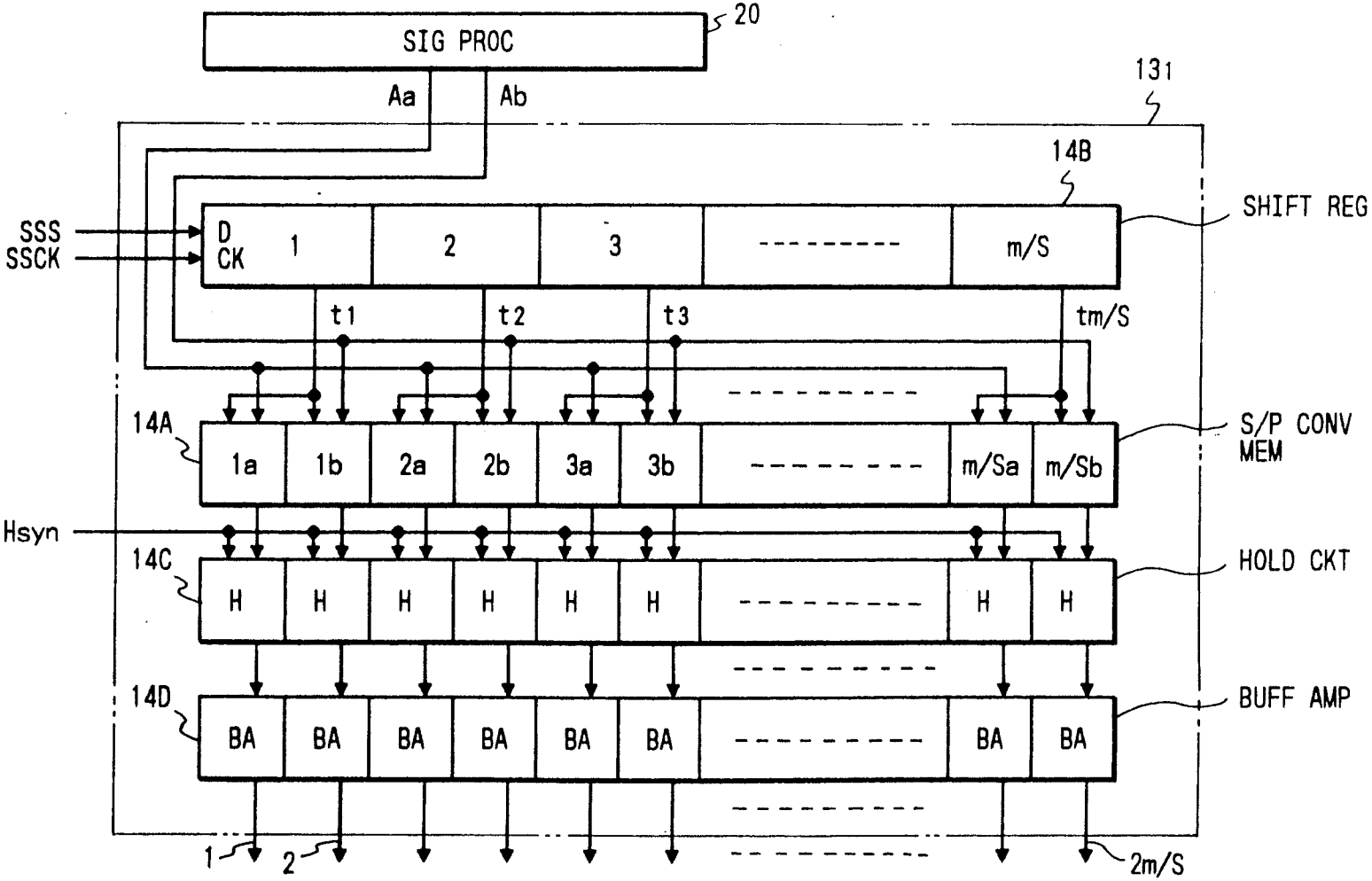
FIG. 6 is a block diagram illustrating an example of the construction of a source driver.

FIG. 6 illustrates an example of the source driver division $13_1$ which is identical in construction with the other source driver divisions $13_2$ to $13_s$. The source driver division $13_1$ comprises: a serial/parallel (hereinafter referred to as S/P) converting memory 14A for converting the m/S pairs of analog gradation data Aa, Ab into parallel data; a shift register 14B whereby timing signals $t_1, t_2, \ldots, t_{m/S}$ for writing the series of pairs of analog data Aa, Ab into memory cell pairs ($1_a$, $1_b$), ($2_a$, $2_b$), . . . , (m/Sa, m/Sb) of the S/P converting memory 14A are sequentially output with the period SP of the source shift clock SSCK; a holding circuit 14C which simultaneously fetches all the parallel outputs of the S/P converting memory 14A and holds them; and a buffer amplifier 14D which outputs in parallel driving voltages corresponding to the levels of the parallel outputs of the holding circuit 14C and supplies them to the corresponding data lines. The memory cells 1*a*, 1*b*, 2*a*, 2*b*, . . . of the S/P converting memory 14A are each composed of, for example, a switch which controls the passage therethrough of the input analog data Aa or Ab and a capacitor which is charged by the voltage of the analog data via the switch, though not shown.

A high-level source start signal SSS synchronized with a horizontal synchronizing signal Hsyn is applied from the control part 10 to a data input of the shift register 14B, and the high level is shifted from first to m/S-th stages one after another by a source shift clock SSCK of the period SP which is S times that of the sampling clocks CK1 and CK2. As the high level is shifted, high-level timing signals $t_1, t_2, \ldots, t_{m/S}$ are provided at the outputs of the respective stages, from which they are applied to the corresponding memory cells of the S/P converting memory 14A, by which the pairs of pieces of analog gradation data Aa and Ab are sequentially stored in the memory cell pairs (1*a*, 1*b*), (2*a*, 2*b*), . . . Upon completion of writing the m/S pieces of analog data into the m/S pairs of memory cells, the horizontal synchronizing signal Hsyn is applied to the hold circuit 14C, which simultaneously fetches and holds the output analog gradation data of the memory cells (1*a*, 1*b*), . . . , (m/Sa, m/Sb). The outputs of the hold circuit 14C are provided to the corresponding data lines 1, 2, . . . , 2m/S via the buffer amplifier 14D. Thus, in the source driver division $13_1$, while the hold circuit 14C holds analog data on a certain line of the display panel 30 and provides the data to the data lines via the buffer amplifier 14D, pieces of analog data Aa, Ab of the next line are sequentially written into the S/P converting memory 14A.

The embodiment shown in FIG. 2 is so constructed as to be capable of interlace scanning in a double definition display mode and includes a gate driver $12_1$ for selectively driving odd gate lines in a sequential order and a gate driver $12_2$ for selectively driving even gate lines in a sequential order. The gate drivers $12_1$ and $12_2$ are each formed by an n-stage shift register and they sequentially shift high-level gate start signals GS1 and GS2 supplied from the control part 10, upon each generation of a gate shift clock GSCK synchronized with the horizontal synchronizing signal Hsyn, thus selectively driving gate lines connected to the stages supplied with the high-level. In the double definition display mode the control part 10 generates, for each odd field, the gate start signal GS1 and applies it to the gate driver $12_1$ and generates, for each even field, the gate start signal GS2 and applies it to the gate driver $12_2$. Consequently, during the odd-field period gate lines 1, 3, 5, . . . , 2n−1 are driven one by one upon each generation of the gate shift lock GSCK, and during the even-field period gate lines 2, 4, 6, . . . , 2n are driven one by one upon each generation of the gate shift clock GSCK. In the standard definition display mode the control part 10 generates, for each field, the gate start signals GS1 and GS2 of the same timing and applies them to the gate drivers $12_1$ and $12_2$. Consequently, upon first generation of the gate shift clock GSCK, the gate lines 1 and 2 are simultaneously driven and analog gradation data of the same line is provided to picture elements on the first and second rows. In response to the next gate shift clock GSCK the gate lines 3 and 4 are simultaneously driven and analog gradation data of the same line is provided to picture elements on third and fourth rows, and thereafter the same operation takes place.

With the arrangement depicted in FIG. 2, in the case of displaying the external input analog image signal VS with a double definition, the sampling clocks SCK1 and SCK2 displaced one-half of the period P or 180° apart in phase are generated from the control part 10, the select switch 18 is set by the select control signal SWC to select the output of the delay circuit 17, and the gate start signals GS1 and GS2 are alternately generated from the control part 10 in the odd-numbered and even-numbered fields, respectively. In consequence, digital sample values of the analog image are obtained in the A/D converters 15 and 16 alternately with each other every P/2 period as shown in FIG. 3. Accordingly, the pieces of data Da and Db of each pair which are input into the S/P converting memories $\mathbf{11}_1$ through $\mathbf{11}_S$ are two consecutive digital sample values corresponding to the input analog image signal VS, and analog voltages corresponding to 2 m pieces of data resulting from the sampling of the input analog image signal with the period P/2 are simultaneously applied to 2 m data lines of the display panel 30 from the source driver divisions $\mathbf{13}_1$ through $\mathbf{13}_S$. As a result of this, individual pieces of picture element data are provided to all of 2 m picture elements connected to a selected one of the gate lines. On the other hand, in the case of the standard definition display, the in-phase sampling clocks SCK1 and SCK2 of the period P are generated from the control part 10, the select switch 18 is set by the select control signal SWC to select the output of the A/D converter 15, and the gate start signals GS1 and GS2 are generated from the control part 10 at the same timing for each field. By this, pairs of pieces of data Da and Db of the same values are provided from the A/D converters 15 and 16 to the S/P converting memories $\mathbf{11}_1$ through $\mathbf{11}_S$ with the same period P, as shown in FIG. 4. In consequence, an analog voltage of the same gradation level is applied to every two data lines, while at the same time every two gate lines are simultaneously driven.

Figure 7A:
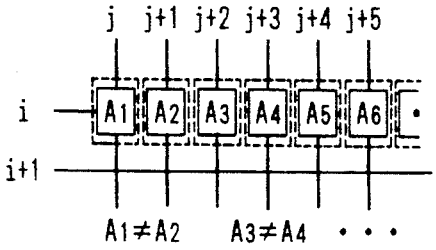
FIG. 7A is a diagram showing a picture element arrangement in the case of a double definition monochrome display.
Figure 7B:
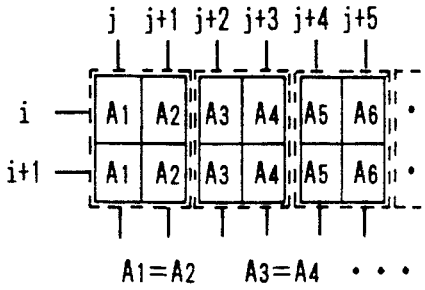
FIG. 7B is a diagram showing a picture element arrangement in the case of a standard definition monochrome display.

FIGS. 7A and 7B partly show picture elements on the display panel in the cases of the double definition and the standard definition displays, respectively. The solid-line squares represent picture elements and the symbol A in each of them indicates analog gradation data which is provided to the picture element. The broken-line squares each represent a smallest resolvable display unit (pixel) of an image displayed. In the standard definition display the pixel is twice larger than that in the double definition display. The numerals (1, 2, 3, suffixed to the symbol A in FIGS. 7A and 7B correspond to the numerals (1, 2, 3, . . . ) suffixed to the time T in FIGS. 3 and 4.

Second Embodiment

In the case where the liquid crystal gradation display panel 30 is a color display panel of the type wherein picture elements are arranged in a delta form as shown in FIG. 1B, the panel 30 is made up of 3 m (m being an integer) column lines and 4 n (n being an integer) row lines and the embodiment of FIG. 2 is modified as described below.

The structure ranging from the analog image signal input terminal 19 to the memories $\mathbf{11}_1$ through $\mathbf{11}_S$ in the FIG. 2 embodiment is provided for each of red, green and blue analog image signals. Accordingly, although in FIG. 2 the source driver divisions $\mathbf{13}_1$ to $\mathbf{13}_S$ each have two inputs, each source driver division in this embodiment has six inputs, because pieces of analog gradation data for each of the red, green and blue image signals are input thereinto in pairs. The phases of the sampling clocks SCK1 and SCK2 which are applied to three pairs of A/D converters and the method of writing data into the memories $\mathbf{11}_1$ to $\mathbf{11}_S$ in the cases of double definition and standard definition displays of red, green and blue input analog image signals are the same as in First Embodiment.

In this embodiment 2S pieces of digital gradation data for each color, that is, a total of 6S pieces of digital gradation data for the red, green and blue colors, are read out in parallel from the S memories $\mathbf{11}_1$ through $\mathbf{11}_S$m/S times. As a result of this, pieces of data for all of 6 m picture elements for the red, green and blue colors, i.e. 2 m picture elements for each color, connected to two adjacent row lines i (i being an odd number) and i+1 in FIG. 1B, are sequentially obtained in groups of 6S. In the signal processing part 10 every 6S pieces of data is subjected to processing for the arrangement of delta picture elements and converted to pieces of analog gradation data, which are sequentially set in the memories $\mathbf{14}_1$ to $\mathbf{14}_S$ of the source driver divisions $\mathbf{13}_1$ to $\mathbf{13}_S$ as shown on the row lines i and i+1 in FIG. 1B.

In the double definition display mode the analog gradation data is provided successively twice, as picture element data, to 3 m column lines from the source driver divisions $\mathbf{13}_1$ through $\mathbf{13}_S$, and in synchronization with each output, two adjacent row lines i and i+1 are selected successively by the gate drivers $\mathbf{12}_1$ and $\mathbf{12}_2$. The series of operations mentioned above are performed 2 n times to thereby display a color image on the liquid crystal display panel. In the case of interlace scanning, however, two adjacent row lines are successively driven every third row lines and the above-mentioned series of operations are successively performed n times for the row lines 1 and 2; 5 and 6; . . . ; 4 n−3 and 4 n−2 in an odd-numbered field and then n times for the row lines 3 and 4; 7 and 8; . . . ; 4 n−1 and 4 n in an even-numbered field; namely, the series of operations are repeated a total of 2 n times to display a frame of a color image on the liquid crystal display panel in this case.

In the standard definition display mode the external input analog image signal VS of each color is converted by the two A/D converters 15 and 16 into the same picture element data which is to be provided to two adjacent or spaced-apart ones out of every three column lines, and the thus converted picture element data is subjected to processing similar to that in the case of the double definition display mode, after which the picture element data is stored in the memories $\mathbf{14}_1$ through $\mathbf{14}_S$ in the source driver divisions $\mathbf{13}_1$ through $\mathbf{13}_S$ so that the picture element data are arranged as shown on the row lines i and i+1 (i being an odd number) in FIG. 1B. When such picture element data of two row lines in the memories are to be provided to the corresponding two row lines of the display panel, two row lines i and i+2 spaced one line apart are simultaneously driven by the, gate driver $\mathbf{12}_1$ first and then a row line i+1 next to rowline i and a row line i+3 spaced one line apart from the row line i+1 are simultaneously driven by the driver $\mathbf{12}_2$. Such a series of operations as mentioned above are successively repeated n times to thereby provide a color image on the liquid crystal display panel.

Figure 8A:
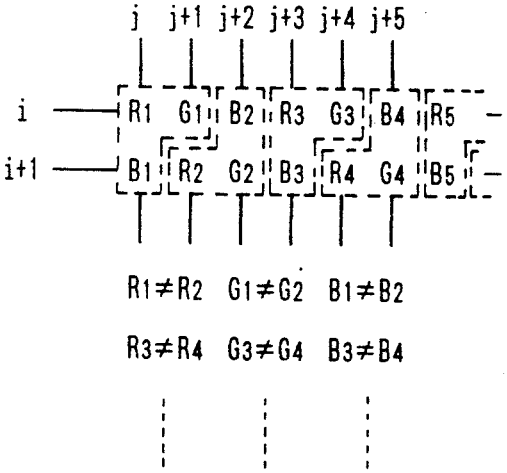
FIG. 8A is a diagram showing delta arrangements of picture elements in the case of a double definition color display.
Figure 8B:
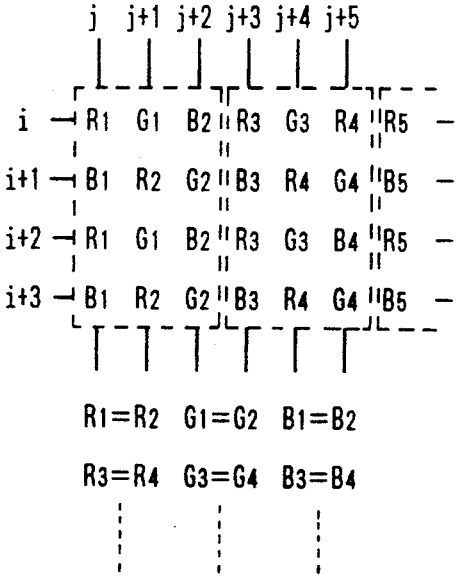
FIG. 8B is a diagram showing delta arrangements of picture elements in the case of a standard definition color display.

FIGS. 8A and 8B show, in broken line, color pixels on the display panel in the case of the double definition and the standard definition display modes, respectively. The pixels in the standard definition display mode are twice larger in both of the row and column direction than in the double definition display mode. The suffixes to the letters R, G and B in FIGS. 8A and 8B correspond to the suffixes to the time T in FIGS. 3 and 4.

Third Embodiment

In the case where the multi-gradation liquid crystal display panel 30 is a color display panel of the type wherein color picture elements of each pixel C are arranged in a stripe form as shown in FIG. 1C, the panel 30 is made up of 6 m (m being integer) column lines and 2 n (n being an integer) row lines, and the embodiment of FIG. 2 is modified as described below.

The structure ranging from the analog image signal input terminal 19 to the memories $11_1$ through $11_S$ in the FIG. 2 embodiment is provided for each of red, green and blue analog image signals; namely, a total of three such structures are provided. In FIG. 2 the source driver divisions $13_1$ through $13_S$ each have two inputs, but in this embodiment each source driver division has six inputs, because pieces of analog data are input thereinto in pairs for each of the red, green and blue colors. The phases of the sampling clocks SCK1 and SCK2 for input into three pairs of A/D converters and the method of writing data into the memories $11_1$ through $11_S$ of the next stage in the case of double definition and standard definition displays of red, green and blue input analog image signals are the same as in the foregoing embodiments.

In this embodiment 2S pieces of digital gradation data for each color, that is, a total of 6S digital gradation data for the red, green and blue colors, are read out in parallel m/S times from the S memories $11_1$ through $11_S$ for each color. As a result of this, pieces of data for all of 6 m picture elements for the red, green and blue colors, i.e. 2 m picture elements for each color, connected to one row line in FIG. 1C are sequentially obtained in units of 6S. In the signal processing part 10 every 6S pieces of data is subjected to processing for the stripe arrangement of picture elements and converted to pieces of analog gradation data, which are sequentially set in the memories $14_1$ through $14_s$ of the source driver divisions $13_1$ through $13_S$ as shown on the row line i in FIG. 1C.

In the double definition display mode the analog gradation data is provided successively, as picture element data, to the 6 m column lines from the source driver divisions $13_1$ through $13_S$, and in synchronization with each output, one row line is selected by the gate drivers $12_1$ and $12_2$ alternately with each other. Such a series of operations as mentioned above are repeated 2 n times to thereby provide a color image on the liquid crystal display panel. In the case of performing interlace scanning in the double definition mode, however, every other row line is driven in an odd-numbered field and the series of operation mentioned above are repeated successively n times from the first line to the (2 n−1)th line, and in the subsequent even-numbered field the operations are repeated n times from the second to the 2 n-th line; namely, the liquid crystal display panel is driven by performing the operations a total of 2 n times to form each frame of display.

In the standard definition display mode the input analog image signal VS of each color is converted by the corresponding pair of A/D converters 15 and 16 into the same picture element data which is to be provided to two column lines spaced two lines apart, and the thus converted picture element data is subjected to the arrangement processing similar to that in the case of the double definition display mode, after which the picture element data is stored in the memories $14_1$ through $14_S$ in the source driver divisions $13_1$ through $13_S$ in such a manner as to provide the arrangement of picture elements on the row line i in FIG. 1C. When such picture element data stored in the memories is provided to the column lines of the display panel, two row lines are simultaneously driven by the gate drivers $12_1$ and $12_2$ in synchronization With the output. A series of such operations are successively repeated n times to thereby provide a color image on the liquid crystal display panel.

Figure 9A:
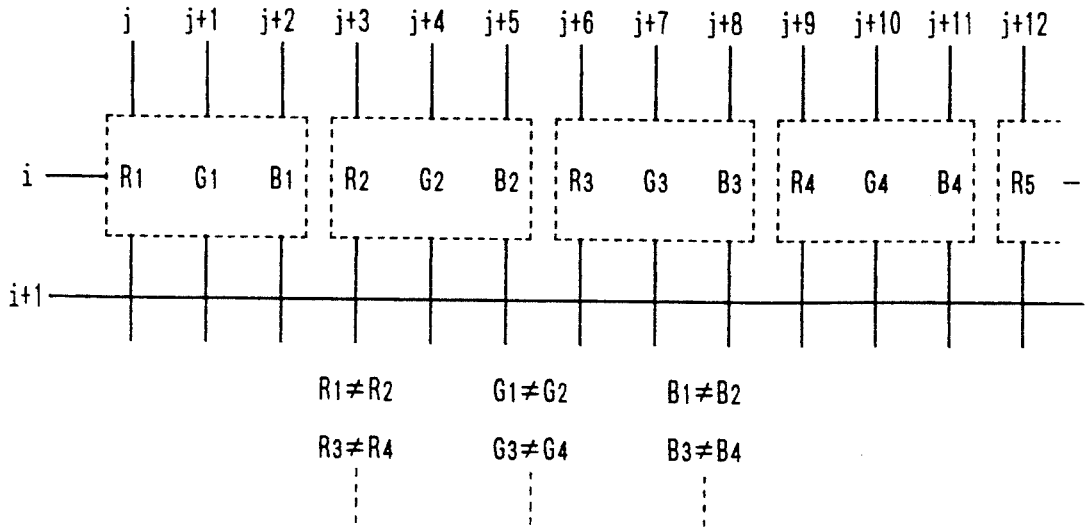
FIG. 9A is a diagram showing stripe arrangements of picture elements in the case of the double definition color display.
Figure 9B:
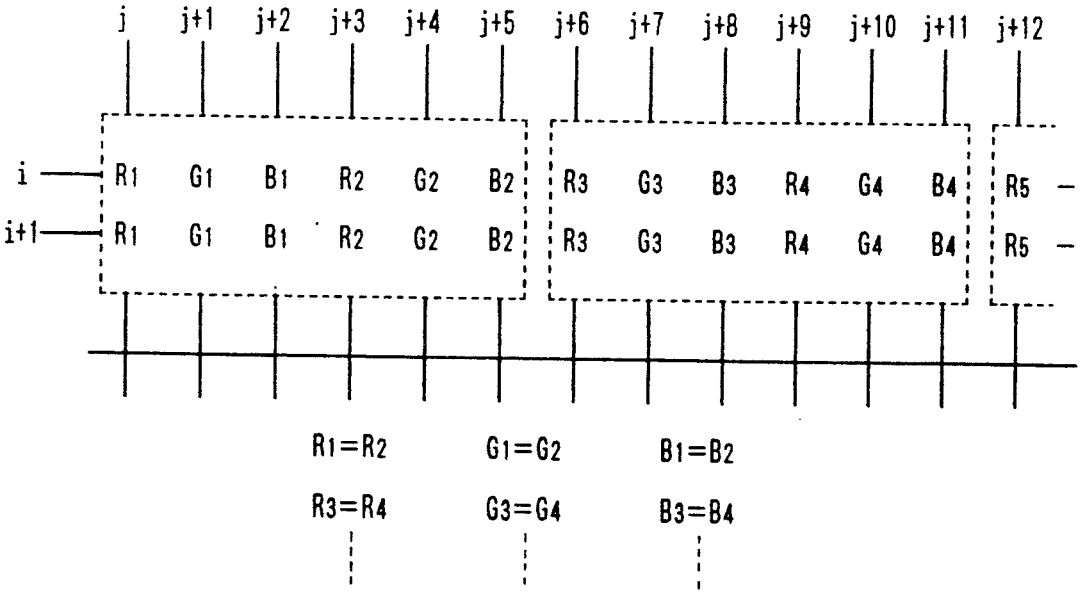
FIG. 9B is a diagram showing stripe arrangements of picture elements in the case of a standard definition color display.

FIGS. 9A and 9B show, in broken line, color pixels on the display panel in the case of the double definition and the standard definition display modes, respectively. The pixels in the standard definition display mode are twice larger in both of the row and column direction than in the double definition display mode. The suffixes to the letters R, G and B in FIGS. 9A and 9B also correspond to the suffixes to the time T in FIGS. 3 and 4 as in the foregoing embodiments.

While in the above embodiments the source driver divisions are disposed at one side of the panel 30, they may also be disposed at both sides of the panel 30 as described later on. Conversely, the gate drivers $12_1$ and $12_2$ may be disposed at one side of the panel 30.

Also in the case of driving the row lines by the gate drivers $12_1$ and $12_2$ disposed at both sides of the panel 30, the driving of the row lines is the same as described above, regardless of the arrangement of the gate drivers $12_1$ and $12_2$. For instance, in the case where the row lines are alternately connected to the gate drivers $12_1$ and $12_2$ disposed at the right-hand and left-hand sides of the panel 30 in First and Third Embodiments, the row lines are alternately driven by the gate drivers $12_1$ and $12_2$ in the case of the double definition display mode, and in the case of the standard definition display mode, two adjacent row lines are simultaneously driven by the both drivers. When the gate drivers $12_1$ and $12_2$ are mounted at the right-hand and left-hand sides of the panel 30, pairs of adjacent row lines are alternately connected to the drivers in the case of Second Embodiment. In the odd-numbered field pairs of adjacent row lines are driven in succession by the one gate driver $12_1$ and then in the even-numbered field pairs of adjacent row lines are driven in succession by the other gate driver $12_2$; namely, interlace driving is performed 2 n times every two fields. In the standard definition display mode pairs of two adjacent row lines are successively driven simultaneously by both gate drivers $12_1$ and $12_2$, and this driving is repeated n times to provide an image display on the panel 30.

In the embodiment depicted in FIG. 2 the two A/D converters 15 and 16 are provided for one analog image signal VS and are operated in either of the double definition and the standard definition display mode, but it is also possible to employ an arrangement in which in the standard definition display mode the analog image signal is converted by one of the A/D converters and then branched into two pieces of data for input into the memories $11_1$ through $11_S$.

In the embodiment shown in FIG. 2 the memories $11_1$ through $11_S$ and the signal processing part 20 are shown and described to be separated from the source driver divisions $13_1$ through $13_S$, but the memories $11_1$ through $11_S$ and the signal processing part 20 may also be incorporated in the source driver divisions $13_1$ through $13_S$.

In the FIG. 2 embodiment, since the double definition display data is a high-speed signal, the memory 11 is divided into S for the serial input to parallel output conversion and the source driver 13 is also divided into S divisions $\mathbf{13}_1$ through $\mathbf{13}_S$ accordingly, but when a source driver of high-speed input operation is available, the number S is reduced in accordance with the speed or may also be 1.

In the above embodiments the range of the selection of row lines (the number of scanning lines) and the range of display by column lines in the double definition display mode have been described to be twice larger than in the standard definition display mode, but it is also possible to form the panel to have a two-fold structure so that both or one of the row and column lines are partly used in the case of the double definition display. In this instance, pieces of data for some picture elements to be connected to a row line on its right-hand and left-hand end portions, for example, are unconditionally set to be black and the pieces of data for the other picture elements are set through utilization of the input analog image signal. The selection of row lines by the gate drivers is so controlled as not to drive some row lines at upper and lower end portions of the panel, for example, and the row and column lines to be used for the actual display are driven in exactly the same manner as in the above embodiments except the number of successive driving of the row lines.

As described above, the driving system of the present invention permits the use of a source driver in common to the double definition and the standard definition display simply by the use of the double definition display panel and the use of two A/D converters for each analog image signal in the source drive system and by changing the phases of the sampling clocks of the A/D converters in accordance with the definition of the input analog image signal from the outside. Thus, the circuit structure can be made common to the double definition and the standard definition displays and can be integrated.

Moreover, by driving one row line or simultaneously driving two adjacent row lines or two row lines spaced one line apart by the gate driver or drivers in synchronization with the output operation of the source driver, depending on whether the display mode is the double definition or standard definition display mode, either of the double definition and the standard definition display can equally be provided on the double definition display panel. This broadens the application of the display panel, eliminates the necessity of preparing both double definition and standard definition display devices, and hence reduces the space consumed by the display device.

Needless to say, the display of the present invention permits free switching between displays by non-interlace and interlace driving.

In the embodiment of FIG. 2 the signal processing part 20 responds to digital gradation data applied thereto to select the corresponding voltage from a multilevel voltage by an analog switch, thus converting the digital gradation data to analog form. For instance, for providing a 16-gradation display by AC driving, there has been proposed a method in which a voltage of 16 levels in each of the positive and negative directions, that is, a voltage having a total of 32 levels, about the center value of the amplitude of a source voltage on which the liquid crystal display driving voltage alternation is based (hereinafter referred to as a reference voltage value $V_{REF}$) is generated, a total of five bits, four for the digital gradation data and one indicating the alternation (polarity), are used to select corresponding voltages from the 32-level voltage and the voltages thus selected are provided to the source driver. In this case, 5-bit decoder and 32 analog switches are needed for selecting one level from the 32 voltage levels. That is, even in the case of the 16-gradation display, the amount of hardware becomes two-fold for inter-frame AC driving which involves reversing the polarity of the analog gradation data for all column lines of the liquid crystal for each frame.

In addition, the above-noted numbers of decoders and analog switches must be doubled for inter-column AC driving (in which the polarity of analog gradation data for each of even-numbered and odd-numbered column lines differs and this polarity is reversed for each frame).

Furthermore, in the cases (1) where a color display is provided on the liquid crystal display panel and (2) where a multiphase clock synchronous transmission for decreasing the effective speed of the source driver owing to its operating speed limit (for example, Hitachi source drive IC: HD 66300 utilizes a three-phase clock synchronous transmission), the numbers of decoders and analog switches needed become as large as three time in the case (1) and 12 times in the case (2) (the three-phase clock synchronous transmission).

In a TFT (Thin Film Transistor) active matrix type liquid crystal display the level of a voltage to be written into each picture element decreases owing to parasitic capacitances of the TFT (a gate-drain capacitance and source-drain capacitance), a capacitance between an ITO layer of each picture element and the source line, etc., and in the case of performing AC driving of each picture element, even if the voltage level to be written into each picture element from the source driver of the liquid crystal display panel is well-balanced in the positive and negative direction with respect to the center value of the amplitude of the source voltage (i.e. the reference voltage), the voltage which is actually written into each picture element and held therein looses it balance, posing a problem such as a display with many flickers.

To avoid this, an alternate driving (intercolumn AC driving) may be employed for driving even-numbered and odd-numbered column lines in the display panel, wherein pieces of positive analog picture element data and negative picture element data are provided from the source driver to the even-numbered and odd-numbered column lines, respectively, in an Nth frame (N=1, 3, 5, . . . or 2, 4, 6, . . . ), and in an (N+1)th frame (N=1, 3, 5, . . . or 2, 4, 6, . . . ) negative analog picture element data and positive analog picture element data are supplied to the even-numbered column line and the odd-numbered column line, respectively. These pieces of data are provided from a digital-to-analog converter to the source driver.

To perform this, the digital-to-analog (hereinafter referred to as D/A) converter has input terminals twice as many as the voltage levels h. In the Nth frame voltages of 2 h values (a group of positive voltages and a group of negative voltages) which decrease stepwise from a positive constant voltage to a negative constant voltage through the reference voltage are applied to the series of input terminals of the D/A converter, whereas in the (N+1)th frame voltages of 2 h values (a group of negative voltages and a group of positive voltages)

which increase stepwise from the negative constant voltage to the positive constant voltage through the reference voltage are applied to the series of input terminals. Furthermore, two decoders in the D/A converter are used to select one of the above-mentioned multi-level input terminals being supplied with the group of positive voltages ranging from the positive constant voltage to the reference voltage and one of the multi-level input terminals being supplied with the group of negative voltages ranging from the negative constant voltage to the reference voltage. In the Nth frame voltages selected from the positive and negative voltage groups are provided, as voltages for the even-numbered and odd-numbered column lines, respectively, to the source driver. In the (N+1)th frame voltages selected from the negative and positive voltage groups are applied, as voltages for the even-numbered and odd-numbered column lines, respectively, to the source driver. By this, it is possible to switch the polarities of the pieces of analog gradation data which are provided to the even-numbered and odd-numbered column lines of the liquid crystal display panel. In addition, there is no need of independently providing D/A converters for the cases of the input thereto changing from positive to negative and from negative to positive, as in the prior art example. Thus, despite the AC driving of the liquid crystal display panel, the amount of hardware for the decoders and the analog switches in the D/A converter need not be increased, and consequently, the amount of hardware used can be reduced by half as compared with that in the prior art.

In anticipation of the drop of the voltage level to be written into the picture element due to the parasitic capacitance and the like of the TFT active matrix type liquid crystal display panel, the above-mentioned positive and negative constant voltages to be supplied to a multi-level power source part every frame period are set so that the potential difference between the positive constant voltage and the reference voltage differs from that between the reference voltage and the negative constant voltage, by which the voltage level to be written into each picture element is varied, permitting well-balanced alternation and hence providing an excellent image display with no flickers.

Figure 10:
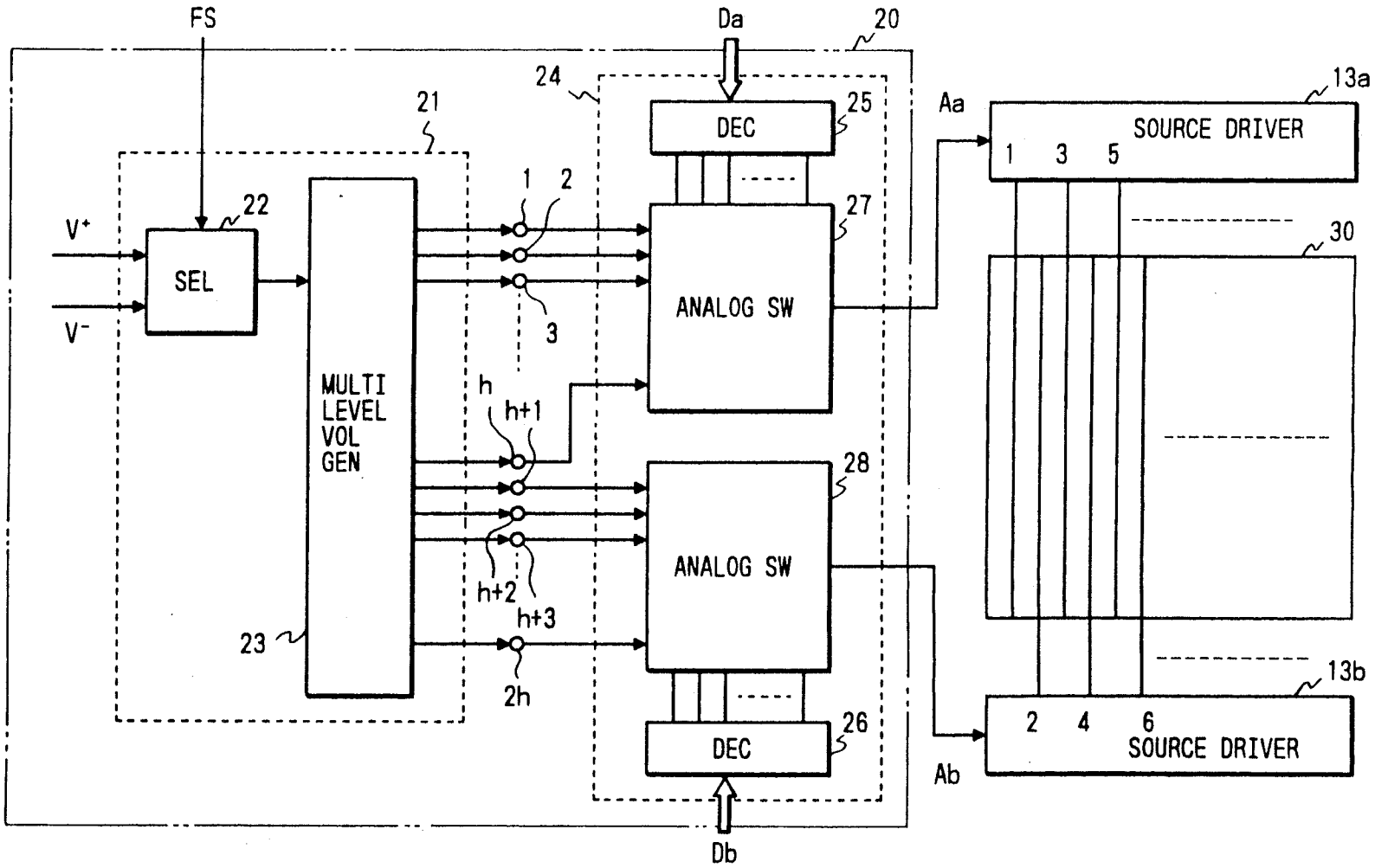
FIG. 10 is a block diagram illustrating an example of the construction of a signal processing part used in the present invention.

An embodiment of the signal processing part 20 which permits the D/A conversion with a small amount of hardware from the above-described point of view is shown in FIG. 10, together with the source driver and the liquid crystal display panel. No gate drivers are shown. In this embodiment the source driver for driving the data lines (column lines) in the display panel 30 is divided into two drivers 13*a* and 13*b*, which are disposed at the upper and lower sides of the panel 30 so that they drive even-numbered and odd-numbered column lines of the panel 30, respectively. In this embodiment S is set to 1 in FIG. 2 for convenience.

According to this embodiment, in a multi-level power supply 21 for generating a multi-level voltage (h values, h being an integer equal or greater than 2) a frame switching signal FS which toggles between high and low levels every vertical synchronizing period (one frame period) is applied from the control part 10 (see FIG. 2) to a selector 22, by which positive and negative constant voltages V+ and V− are alternately interchanged with each other and applied to a multi-level voltage generator 23. In accordance with the combination of the constant voltages V+ and V− or V− and V+ the multi-level voltage generator 23 provides, to its 2 h terminals 1 through 2 h, h positive level voltages and h negative level voltages which sequentially vary from the positive to the negative or negative to positive direction within voltage widths corresponding to the magnitudes of the constant voltages. For instance, in the case where the combination of constant voltages V+ and V− is selected in a certain frame period and applied to the multi-level generator 23, 2 h different voltages varying from the positive to the negative direction are output therefrom. The h positive voltage outputs at the terminal 1 through h and the h negative voltage outputs at the terminals h+1 through 2 h are applied to analog switches 27 and 28 in a D/A converter 24. On the other hand, the pieces of digital gradation data Da and Db of successive pairs are input into decoders 25 and 26, respectively. Two voltages corresponding to the data Da and Db of each pair are selected, by the analog switches 27 and 28, from the respective h positive voltages and the h negative voltages provided to the analog switches 27 and 28, by which the digital gradation data Da and Db are converted into the analog gradation data Aa and Ab. The thus converted two analog outputs Aa and Ab are applied to the source drivers 13*a* and 13*b*. As a result of this, the even-numbered and odd-numbered column lines are driven by the positive and negative analog values from the source drivers 13*a* and 13*b*, respectively. When in the next vertical synchronizing period (one frame period) the combination of constant voltages V− and V+ is selected by the selector 22 in accordance with the frame switching signal FS and is applied to the multi-level voltage generator 23, 2 h different voltages varying from the negative to the positive direction are provided at the terminals 1 through 2 h. Consequently, h negative voltages are output at the terminals 1 through h and h positive voltages are output at the terminals h+1 through 2 h, and these voltages are applied to the analog switches 27 and 28. On the other hand, two voltages are selected from the h negative voltages and the h positive voltages, respectively, by the decoders 25 and 26 and the analog switches 27 and 28 in accordance with the digital gradation data Da and Db of each pair, by which the pieces of digital gradation data Da and Db are converted into the pieces of analog gradation data Aa and Ab. These pieces of analog gradation data Aa and Ab are provided to the source drivers 13*a* and 13*b*, respectively, by which even-numbered and odd-numbered column lines are driven, based on the data of the negative analog value and the data of the positive analog value from the source drivers 13*a* and 13*b*. Thus, upon each switching of frame, the polarity of the voltage applied to the picture elements connected to each column lines is reversed for AC driving.

Accordingly, this embodiment does not call for independent provision of a D/A converter for selecting a voltage from 2 h voltages varying from the positive to the negative direction in accordance with the digital data and a D/A converter for selecting a voltage from the 2 h voltages varying from the negative to the positive direction in accordance with the digital data, and the D/A converter 24 can be formed by the 2 h analog switches 27 and 28 connected to the terminals 1 through 2 h and the decoders 25 and 26; so that the amount of hardware used can be reduced.

In the above embodiment the source drivers 13*a* and 13*b* are disposed at the upper and lower sides of the display panel 30 for driving the even-numbered column lines and the odd-numbered column lines, respectively, but the source drivers 13*a* and 13*b* may also be arranged to drive the odd-numbered column lines and the even-numbered column lines, respectively. The source drivers 13*a* and 13*b* may also be disposed at one side, and they are not limited to any particular arrangement.

Although the above embodiment has been described using the multi-level power supply 21, the D/A converter 24, the source drivers 13*a* and 13*b* and the analog gradation data Aa and Ab, a color multi-gradation liquid crystal display can be implemented by providing the above-described structure for the picture element data of each of the red, green and blue colors.

The above embodiment has been described on the assumption that S=1 in FIG. 2, but when S is equal to or greater than 2, S sets of paired decoders 25 and 26 and paired analog switch portions 27 and 28 composed of the 2 h analog switches are provided, in which case the 2 h inputs of each paired analog switches are connected in common to the 2 h output terminals 1 through 2 h of the multi-level power supply 21 and each pair of analog outputs Aa and Ab are connected to the corresponding divided parts of the source drivers 13*a* and 13*b*, respectively.

Figure 11:
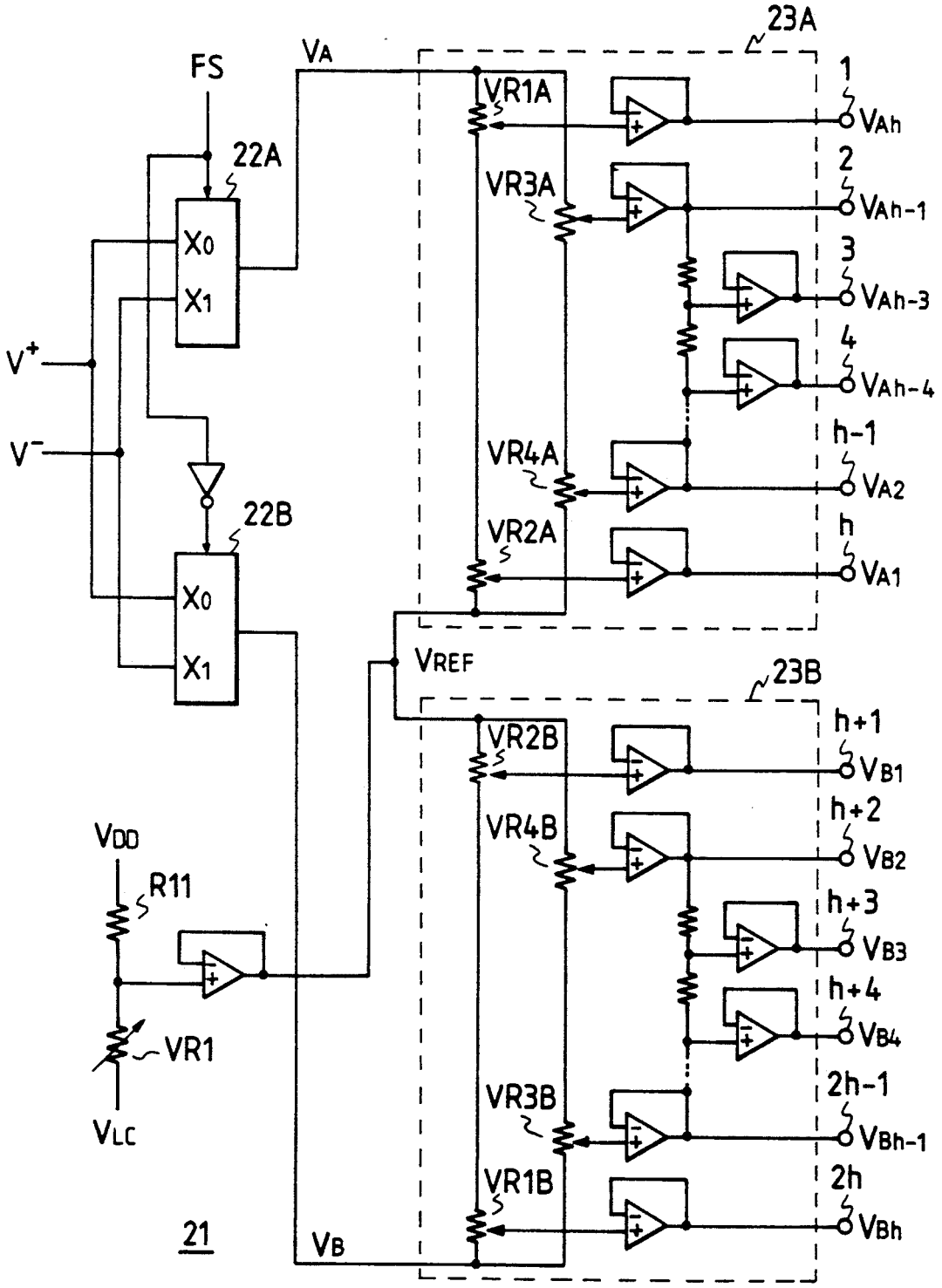
FIG. 11 is a specific operative circuit diagram of a multilevel voltage generator for use in the present invention.

FIG. 11 illustrates an example of the construction of the multi-level power supply 21 for generating a multi-level (h values, h being an integer equal to or greater than 2) voltage in the signal processing part 20 shown in FIG. 10. The constant voltages $V^+$ and $V^-$ are selectively output by two selectors 22A and 22B in response to the frame switching signal FS which toggles between the high and low levels. For exmple, when the frame switching signal FS is high-level in a certain frame, the selector 22A selects the constant voltage $V^+$ and the selector 22B selects the constant voltage $V^-$ and 22A and 22B apply them as voltages $V_A$ and $V_B$ to multi-level voltage generators 23A and 23B, respectively. On the other hand, the reference voltage $V_{REF}$ of the source voltage Of the liquid crystal display panel is produced using positive and negative voltages $V_{DD}$ and $V_{LC}$ and is applied to the multi-level voltage generators 23A and 23B. The multi-level voltage generator 23A provides h voltages $V_{Ah}$ to $V_{A1}$ to terminals 1 to h, using the voltages $V^+$ and $V_{REF}$ and pluralities of buffer amplifiers and dividing resistors. The multi-level voltage generator 23B outputs h voltages $V_{B1}$ to $V_{Bh}$ to terminals 1 to h, using the voltages $V_{REF}$ and $V^-$ and pluralities of buffer amplifiers and dividing resistors. In the next frame period the selectors 22A and 22B select the voltages $V^-$ and $V^+$, respectively, in response to the low-level frame switching signal FS and apply them as voltages $V_A$ and $V_B$ to the multi-level voltage generators 23A and 23B, respectively. Consequently, the voltages at the terminals 1 to 2 h provided from the multi-level voltage generators 23A and 23B are reverse in polarity from the corresponding voltages in the preceding frame.

In the case where it is necessary to change the voltage levels to be written into the picture elements so as to implement well-balanced alternation of the picture element voltages in anticipation of the decrease in the voltage levels owing to the parasitic capacitance and the like of the TFT active matrix type liquid crystal display panel, the values of the constant voltages $V^+$ and $V^-$ of different polarities which are applied to the multi-level power supply 21 are changed, or the reference voltage $V_{REF}$ is changed by use of resistors R11 and VR1, whereby the voltage width (a maximum positive amplitude value of the source write-in voltage) from the reference voltage $V_{REF}$ to a maximum voltage value in the positive direction ($V_{Ah}$ or $V_{Bh}$ for each frame), or the voltage width (a maximum negative amplitude value of the source write-in voltage) from the reference voltage $V_{REF}$ to a maximum voltage value in the negative direction ($V_{Bh}$ or $V_{Ah}$ for each frame) can be varied and adjusted. In the case where such voltage widths are equal to each other, the voltage values of the voltages $V^+$ and $V^-$ to be supplied to the multi-level power supply 21 or the reference voltage $V_{REF}$ is set so that $V^+ - V_{REF} = V_{REF} - V^-$.

Incidentally, variable resistors VR1A to VR4A and VR1B to VR4B in the multi-level voltage generators 23A and 23B are provided for setting the gradient of the h-value voltage variations. From the viewpoint of well-balanced liquid crystal display panel alternate driving, it is desirable that the resistance values of the resistors VR1A and VR1B, VR2A and VR2B, VR3A and VR3B, and VR4A and VR4B can be set in association with each other.

As described above, the signal processing part 20 shown in FIG. 10 comprises the D/A converter 24 for providing the pieces of analog gradation data Aa and Ab to the source drivers 13*a* and 13*b* for driving the column lines of the display panel, and the multi-level power supply 21 for supplying the D/A converter 24 with the positive and negative multi-level voltages of the same m=number as the number of gradation h. For alternate driving of the column lines of the liquid crystal display panel voltages corresponding to the pieces of digital gradation data Da and Db are selected by the D/A converter 24 from the above-mentioned positive multi-level and negative multi-level voltages and provided, as pieces of analog gradation data Aa and Ab for the even-numbered and odd-numbered column lines of the display panel, to the source drivers 13*a* and 13*b*, and a voltage which changes its polarity every frame is applied to the multi-level power supply 21, by which the positive and negative multi-level voltages to be applied to the D/A converter 24 is switched between them, and consequently, the polarities of the pieces of analog gradation data Aa and Ab which are provided to the even-numbered column lines and the odd-numbered column lines can be switched. Accordingly, it is not necessary to switch data lines between the source drivers 13*a* and 13*b* for reversing the polarity of the analog gradation data nor is it necessary to switch the connection of the even-numbered and odd-numbered column lines at the outputs of the source drivers 13*a* and 13*b*. Thus, AC driving of the column lines of the liquid crystal display panel is possible with a structure which is small in the number of switching operations.

With an arrangement in which pieces of analog gradation data for even-numbered and odd-numbered column lines are provided by the D/A converter including two sets of analog switches connected to 2 h input terminals which are supplied with 2 h-value voltages changing from the positive to the negative direction and vice versa upon each switching of the frame and two sets of decoders in the case of providing a display through utilization of the pieces of analog data Aa and Ab indicating h gradations, the number of decoders and the number of analog switches forming the D/A converter are small.

Moreover, since the positive multi-level voltage value and the negative multi-level voltage value from the center value of the source voltage can be freely set by changing the values of the positive and negative constant voltages which are applied to the multi-level power supply for each frame period, the voltage level which is written into each picture element from the source driver of the liquid crystal display panel can be changed in anticipation of a decrease of the voltage level in the picture element owing to the parasitic capacitance or the like of the TFT active matrix type liquid crystal display panel. This permits well-balanced AC driving of the column lines of the display panel and hence allows a flickerless excellent image display.

It will be apparent that many modifications and variations may be effected without departing from the scope of the novel concepts of the present invention.

What is claimed is:

1. A liquid crystal display device comprising:

first A/D converting means for sampling an input analog image signal upon each generation of a first sampling clock and for converting it into first digital gradation data;

second A/D converting means for sampling said input analog image signal upon each generation of a second sampling clock of the same period as said first sampling clock and for converting it into second digital gradation data;

delay means connected to the output of said first A/D converting means, for delaying said first digital gradation data for about one-half the period of said first sampling clock;

select switch means supplied with the outputs of said first A/D converting means and said delay means, of selecting and outputting either one of the outputs of said first A/D converting means and said delay means in response to a select control signal;

signal processing means supplied, as a pair of digital gradation data, with the outputs of said select switch means and said second A/D converting means, for converting the outputs of said select switch means and said second A/D converting means into analog values for output as a pair of analog gradation data;

a display panel including a plurality of row lines, a plurality of column lines and picture elements arranged corresponding to the respective intersections between said row lines and said column lines for providing a gradation display in response to analog gradation data which is provided to each of the picture elements selected by said column and row lines;

source drive means supplied with said pair of analog gradation data in a sequential order, for converting said pair of analog gradation data into parallel pairs of analog gradation data for each predetermined number of pairs and providing them to the corresponding column lines of said display panel;

gate drive means for selectively driving said plurality of row liens of said display panel; and control means whereby, in a double definition display mode, said first and second sampling clocks are generated after being displaced 180° apart in phase and said select control signal is generated for controlling said select switch means to select the output of said delay means and, in a standard definition display mode, said first and second sampling clocks are generated in phase with each other and said select controls signal is generated for controlling said select switch means to select the output of said first A/D converting means.

2. The liquid crystal display device of claim 1, wherein said gate drive means includes mean which is controlled by said control means so that, in said double definition display mode, it sequentially drives odd-numbered ones of said row liens in respective odd-numbered fields and even-numbered ones of said row lines in respective even-numbered fields.

3. The liquid crystal display device of claim 1 or 2, wherein said gate drive means includes mean which is controlled by said control means so that, in said standard definition display mode, it sequentially drives said row lines two at a time in each frame.

4. The liquid crystal display device of claim 1, wherein said signal processing means includes S memories which are supplied with said pairs of digital gradation data, S being an integer equal to or greater than 2, said S memories being sequentially supplied with a write enable signal and said pairs of digital gradation data being sequentially written into said S memories during the application thereto of said write enable signal.

5. The liquid crystal display device of claim 4 wherein said pairs of digital gradation data are read out of said S memories while a read enable signal is applied in common to said memories from said control means, and wherein said signal processing means includes S D/A converting means which are supplied with said pairs of digital gradation data read out of said S memories and convert said pairs of digital gradation data into paris of analog gradation data.

6. The liquid crystal display device of claim 5, wherein said source drive means includes S source driver divisions which are supplied with said pairs of analog gradation data from said S D/A converting means, each of said source driver divisions including a serial-to-parallel converting memory which reads thereinto a predetermined number of said pairs of analog gradation data supplied in a sequential order and outputs them in parallel.

7. The liquid crystal display device of claim 1, wherein said signal processing means includes: multi-level voltage generating means for outputting a first set of multi-level voltages and a second set of multi-level voltages which reverse their polarities for each frame and are opposite in polarity from each other; first D/A converting means supplied with one of two pieces of each said pair of digital gradation data for selecting from said first set of multi-level voltages one voltage in accordance with said one piece of said digital gradation data and outputting it as said one piece of said analog gradation data; and second D/A converting means supplied with the other piece of each said pair of digital gradation data for selecting from said second set of multi-level voltages one voltage in accordance with said other piece of said digital data and outputting it as said other piece of said pair of analog gradation data.

8. The liquid crystal display device of claim 7, wherein said multi-level voltage generating means includes: first selector means which is supplied with positive and negative constant voltages and selects and outputs said positive constant voltage when a frame switching signal which toggles between high and low levels; every frame is at the one of said levels and selects and outputs said negative constant voltage when said frame switching signal is at the other level; second selector means which is supplied with said positive and negative constant voltages and selects and outputs said negative constant voltage when said frame switching signal is at said one level, and selects and outputs said positive constant voltage when said frame switching signal is at the other level; a first multi-level voltage generator which is supplied with the output voltage of said first selector means and a reference voltage and outputs a plurality of voltage levels between them as said first set of multi-level voltages; and a second multi-level voltage generator which is supplied with the output of said second selector means and said reference voltage and outputs a plurality of voltage levels between them as said second set of multi-level voltages.

9. The liquid crystal display device of claim 7 or 8, wherein said source drive means includes: a first source driver which is supplied with one of the pair of said pair of analog gradation data, for driving odd-numbered row lines of said display panel; and a second source driver which is supplied with the other of said pair of analog gradation data, for driving even-numbered row lines of said display panel.

10. A liquid crystal display panel driving method for providing an image on a liquid crystal display panel in a switched one of double definition and standard definition display modes, comprising:

a step wherein, in said double definition display mode, an input analog image signal is sampled by two A/D converters, using two sampling clocks of the same period but 180° out of phase with each other and the output of one of said A/D converters is delayed for one-half period of said sampling clocks to generate a pair of digital gradation data of the same timing;

a step wherein, in said standard definition display mode, said input analog image signal is sampled by at least one of said A/D converters, using one of said sampling clocks to generate a pair of equal pieces of digital gradation data;

a step wherein said pair of digital gradation data is converted by signal processing means into a pair of analog gradation data;

a step wherein said pair of analog gradation data is subjected to serial-to-parallel conversion by a source driver and said pieces of digital gradation data thus converted into parallel form is supplied in parallel to column lines of said display panel; and a step wherein row lines of said display panel are selectively driven by said gate driver.

11. The method of claim 10, wherein said row lines are driven by said gate driver, one by one, in said double definition display mode.

12. The method of claim 10, wherein said selective driving of said row lines by said gate driver in said double definition display mode is performed by alternately driving sequentially selected ones of odd-numbered row lines and sequentially selected ones of even-numbered row lines for each field.

13. The method of claim 10, wherein in said double definition display mode said driving of sequentially selected said row lines by said gate driver is performed by switching, for each field, between sequential selective driving of every two adjacent row lines at intervals of two lines in a certain frame and sequential selective driving of every two row lines skipped over in the preceding frame.

14. The method of claim 11, 12, or 13, wherein in said standard definition display mode said driving of said row lines is performed by repeating simultaneous driving of every two adjacent row lines.

15. The method of claim 10, wherein said step of converting said pair of digital gradation data to said pair of analog gradation data includes a step of generating first and second sets of multi-level voltages which reverse their polarities for each frame and are reverse in polarity from each other, and a step of selecting one of said multi-level voltages of each of said first and second sets in accordance with one and the other of said pair of digital gradation data and outputting them as one and the other of said pair of analog gradation data.

* * * * *